US005964148A

United States Patent [19]

Ishii

[11] Patent Number: 5,964,148

[45] Date of Patent: Oct. 12, 1999

[54] STENCIL SHEET DISCHARGE DEVICE OF ROTARY PRINTER HAVING INK CONTAMINATION PROTECTOR

[75] Inventor: Shigenori Ishii, Tokyo, Japan

[73] Assignee: Riso Kagaku Corporation, Tokyo, Japan

[21] Appl. No.: 09/023,119

[22] Filed: Feb. 13, 1998

[30] Foreign Application Priority Data

Feb. 21, 1997 [JP] Japan ..... 9-054096

[51] Int. Cl.[6] ..... B41L 13/04

[52] U.S. Cl. ..... 101/116; 101/477

[58] Field of Search ..... 101/114, 116, 101/477, 117, 118, 479, 484, 485

[56] References Cited

U.S. PATENT DOCUMENTS

| | | | |
|---|---|---|---|
| 4,628,813 | 12/1986 | Hasegawa et al. | 101/116 |
| 5,090,310 | 2/1992 | Motoe | 101/114 |
| 5,549,045 | 8/1996 | D'Heureuse et al. | 101/477 |
| 5,560,299 | 10/1996 | Takahira | 101/477 |
| 5,575,213 | 11/1996 | Kawai et al. | 101/477 |
| 5,619,917 | 4/1997 | Takahira | 101/477 |
| 5,623,871 | 4/1997 | Takahira | 101/477 |

FOREIGN PATENT DOCUMENTS

| | | |
|---|---|---|
| 0 657 296 A1 | 6/1995 | European Pat. Off. . |
| 0 714 783 A2 | 6/1996 | European Pat. Off. . |
| 7-32716 | 2/1995 | Japan . |

*Primary Examiner*—Ren Yan
*Attorney, Agent, or Firm*—Oliff & Berridge, PLC

[57] ABSTRACT

In a stencil sheet discharge device having a pair of stencil sheet discharge rollers for transferring a stencil sheet removed from the outer circumferential surface of a printing drum of a rotary stencil printer toward a stencil sheet disposal spot, it is prevented that the trailing end of the stencil printer mounted around the printing drum is contaminated with ink by a contact with the stencil sheet discharge rollers, by a cover member being provided between at least one of the pair of stencil sheet discharge rollers and the printing drum. The cover member may be movable between an operating position interposed between the at least one of the pair of stencil sheet discharge rollers and the printing drum and a non-operating position for exposing the pair of stencil sheet discharge rollers to the printing drum.

4 Claims, 3 Drawing Sheets

STENCIL SHEET DISCHARGE DEVICE OF ROTARY PRINTER HAVING INK CONTAMINATION PROTECTOR

BACKGROUND OF THE INVENTION

1. Field of the Invention

The present invention relates to a stencil printer, and more particularly, to a stencil sheet discharge device for discharging a used stencil sheet from a printing drum of a rotary type stencil printer.

2. Description of the Prior Art

A rotary stencil printer having a cylindrical printing drum is known. In such a rotary stencil printer, a stencil sheet perforated according to an image (called "master") is mounted over an outer circumference of a printing drum having an ink permeable wall structure with its leading end held by a clamp means, and print sheets are transferred one by one through a nip region between the printing drum and a back press roller, so that the print sheets are applied with a printed image by ink supplied to the inside of the printing drum and squeezed out through the perforated portions of the master.

In order to discharge a used master from the printing drum after the end of printing, a stencil sheet discharge device was proposed by the same assignee as that of the present application as described in Japanese Patent Laid-open Publication 7-32716. This stencil sheet discharge device comprises a pair of stencil sheet discharge rollers positioned close to the printing drum and is adapted to draw out the master from the printing drum, starting from its leading end, according to a rotation of the printing drum, and to transfer the master to a stencil sheet disposal spot.

The stencil sheet is generally a multi-layered sheet of a synthetic resin film and a perforated sheet such as Japanese paper, and is therefore apt to curl to the side of the resin film due to a difference in the thermal expansion coefficient between the two sheet materials. Since the master is mounted around the printing drum with its resin film side being positioned outside, with its leading end being fastened to the printing drum by a damp means, while its trailing end being left free, there is a tendency that the trailing end of the master lifts up from the circumferential surface of the printing drum according to such a curling of the master (called "upcurl" hereinbelow). Further, when the printing drum is rotating, the trailing end of the master not fastened to the circumferential surface of the printing drum is apt to lift up therefrom also according to a centrifugal force applied thereto. If the trailing end of the master touches the stencil sheet discharge rollers at its resin film surface due to the above-mentioned upcurl and/or the lifting up by the centrifugal force, the resin film surface is contaminated with the ink attached on the surface of the stencil sheet discharge roller, and there occurs an ink contamination of the back press, as it contacts with the resin film surface of the master. The ink contamination of the back press roller according to such a process proceeds with the repetition of the printing process, possibly causing a heavy ink contamination of the printer.

SUMMARY OF THE INVENTION

In view of such a problem, it is a primary object of the present invention to provide a stencil sheet discharge device which does not cause such an ink contamination of the rotary printer due to the contact between the stencil sheet discharge rollers for drawing up a used master and the trailing end of the used master.

According to the present invention, the above-mentioned object is accomplished by a stencil sheet discharge device of a rotary stencil printer having a pair of stencil sheet discharge rollers for transferring a stencil sheet removed from an outer circumference of a printing drum toward a stencil sheet disposal spot, wherein said stencil sheet discharge device comprises a shield means positioned between at least a part of said pair of stencil sheet discharge rollers and said printing drum.

In the above-mentioned stencil sheet discharge device, said shield means may be movable between an operating position thereof at which said shield means is positioned between at least a part of said pair of stencil sheet discharge rollers and said printing drum and a non-operating position thereof at which said shield means does not obstruct said pair of stencil sheet discharge rollers from being exposed to said printing drum.

Or, the above-mentioned object is accomplished according to the present invention by a stencil sheet discharge device of a rotary stencil printer having a pair of stencil sheet discharge rollers for transferring a stencil sheet removed from an outer circumference of a printing drum toward a stencil sheet disposal spot, a rotary member positioned apart from one of said pair of stencil sheet discharge rollers, and an endless belt suspended around said one of said pair of stencil sheet discharge rollers and said rotary member, wherein said stencil sheet discharge device comprises a shield means adapted to be positioned at a shielding position located between a stencil sheet receiving area defined between said pair of stencil sheet discharge rollers and said printing drum when the stencil sheet discharge device is in a non-operating state thereof so as to shield at least a part of said pair of stencil sheet discharge rollers against said printing drum, and a support means adapted to support said shield means at said shielding position and said rotary member at a retreat position thereof, respectively, when the stencil sheet discharge device is in said non-operating state, said support means being movable to move said rotary member around a central axis of said one of said pair of stencil sheet discharge rollers to an advance position thereof close to said printing drum and to move said shield means to an open position thereof not obstructing said stencil sheet receiving area from being exposed to said printing drum.

In this case, said shield means may be biased to said shielding position by a biasing means and adapted to be moved to said open position by said support means against a biasing force of said biasing means.

Further, said support means may be a pivotable means having an elongated hole for supporting a shaft of said rotary member to be movable therealong, and said shield means may be a pivotable means having an arm means, said arm means having an end slidably engaged with a side portion of said support means so that said shield means is moved between said shielding position and said open position in synchronization with a pivotal movement of said support means for moving said rotary member between said retreat position and said advance position.

BRIEF DESCRIPTION OF THE DRAWING

In the accompanying drawings.

DESCRIPTION OF THE EMBODIMENTS

In the following, the stencil sheet discharge device according to the present invention will be described in detail with respect to some embodiments thereof with reference to the accompanying drawings.

Figure 1:
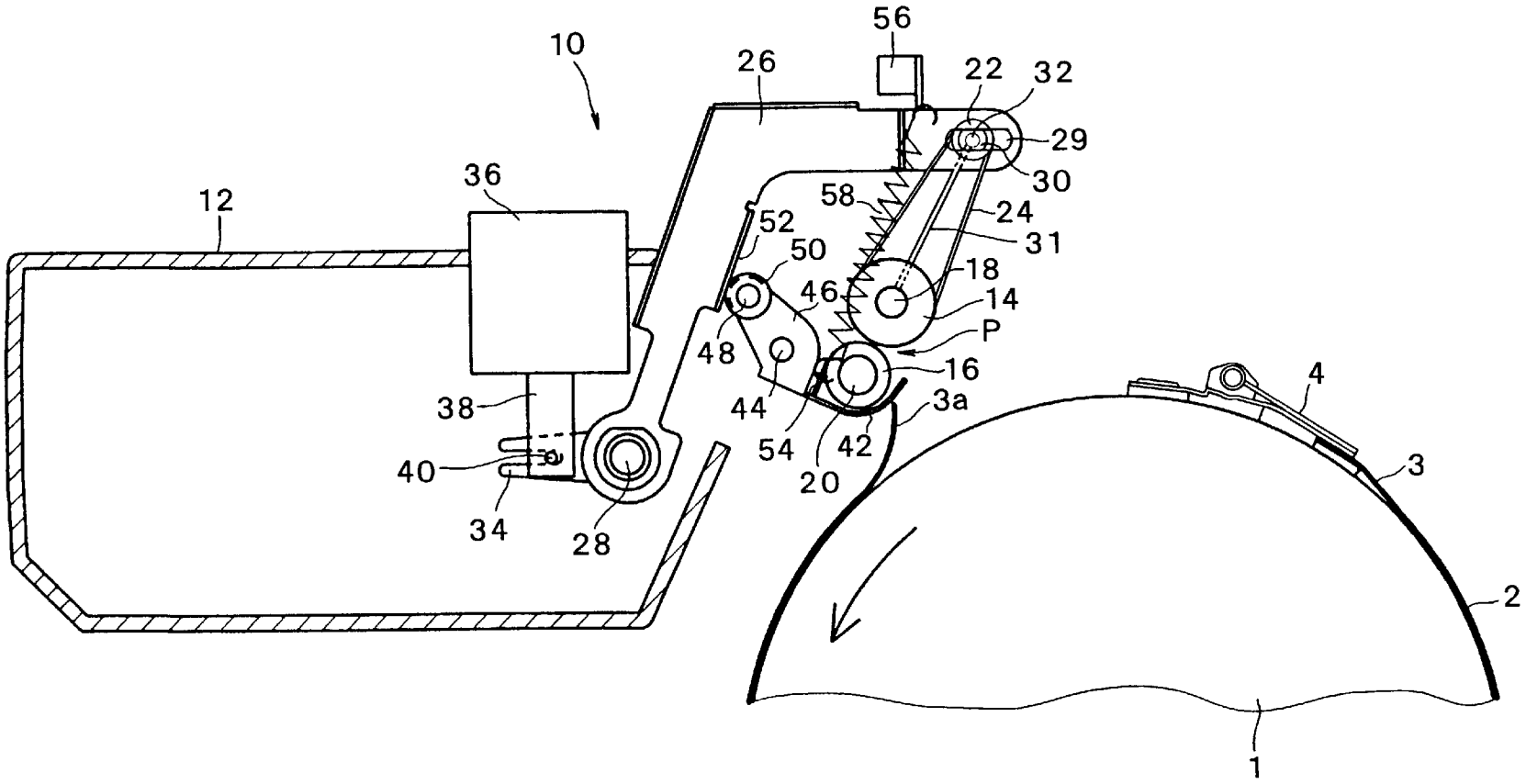
FIG. 1 is a side view showing an embodiment of the stencil sheet discharge device according to the present invention in its non-operating state.

Referring first to FIG. 1, there is a side view showing a stencil sheet discharge device totally indicated by 10 together with a part of a printing drum 1. The stencil sheet discharge device is shown in its non-operating state. The printing drum 1 adapted to be rotationally driven has an ink permeable circumferential wall and includes an ink supply means incorporated therein but not shown in the figure. The printing drum 1 carries a master 3 mounted over its outer circumferential surface 2, with the leading end of the master being held by a clamp means 4 provided along a generatrix of the cylindrical configuration of the outer circumferential surface of the printing drum. The stencil sheet discharge device 10 comprises stencil sheet discharge rollers 14 and 16 positioned close to the outer circumferential surface of the printing drum 1 so as to draw a used master off from the printing drum and to transfer it toward a stencil sheet disposal box 12. In the shown embodiment, the upcurl of the trailing end 3*a* of the master mounted around the printing drum is of an extent of touching only stencil sheet discharge roller 16 positioned closer to the printing drum. This is a phenomenon generally observed. However, it can sometime occur that the upcurl is so large as to touch also the stencil sheet discharge roller 14. In such a case, it is effective to modify the stencil sheet discharge device as described later.

The pair of stencil sheet discharge rollers 14 and 16 pressed against one another and rotated in mutually opposite directions define a master receiving area P. The stencil sheet discharge rollers 14 and 16 are respectively supported by shafts 18 and 20 which in turn are supported by a frame of the printer not shown in the figure. The stencil sheet discharge rollers 14 and 16 are each formed of a plurality of roller pieces arranged along each said shaft. A rotary member 22 is arranged as spaced upward from the stencil sheet discharge roller 14 in parallel thereto, and a plurality of endless belts 24 are expanded around the stencil sheet discharge roller 14 and the rotary member 22. These endless belts 24 operate as a means for guiding the leading end of the master to the master receiving area P in discharging the master. The stencil sheet discharge roller 14 is formed with circumferential grooves of a depth corresponding to the thickness of the endless belts 24 so that the stencil sheet discharge roller 14 exhibits a smooth outer circumferential surface with the endless belts 24 being engaged in the circumferential grooves. In the shown embodiment, the rotary member 22 is also formed with similar circumferential grooves having a depth corresponding to the thickness of the endless belts for receiving them.

The shafts 18 and 20 carry a set of gear wheels not shown at respective one end thereof, the set of gears meshing with each other so as to drive the shafts in synchronization with one another in opposite directions. The shaft 20 is connected with a driving means not shown in the figure at another end thereof to be driven thereby during a stencil sheet discharge operation.

A support member 26 is pivotably mounted to the frame of the printer not shown by a pivot shaft 28. The support member 26 is provided with an elongated hole 29 at its free end portion. In the elongated hole there is received a shoe member 30 to be slidable therealong, the shoe member rotatably supporting the rotary member 22 by a shaft 32. The distance between the axes of the shaft 18 and 32 is maintained to be constant by a rod member 31. The support member 26 has a forked arm portion 34 near its pivoted portion, by which it is engaged with an armature 38 of a solenoid actuator 36 by a pin 40, so as thereby to be selectively pivoted around the pivot shaft 28.

A roller cover 42 forming an essential portion to the present invention is mounted to the frame of the printer by a pivot shaft 44, so as to extend along the outer circumferential surface of the stencil sheet discharge roller 16, so as thereby to shield the stencil sheet discharge roller 16 against the printing drum 1. The roller cover 42 has an arm portion 46 extending from its pivoting portion. A roller 50 is pivotably mounted to an end portion of the arm portion 46 by a shaft 48, the roller 50 being engaged to a guide surface 52 provided along a side portion of the support member 26. The engagement of the roller 50 with the guide surface 52 is maintained by the roller cover 42 being biased around the pivot shaft 44 in the counter-clockwise direction in the figure by a tension coil spring 58 expanded between a lug portion 54 provided in the roller cover 42 and a lug portion 56 provided in the frame of the printer.

When the printing drum 1 is rotated in the direction shown by an arrow in FIG. 1, even if the trailing end 3*a* of the master forms an upcurl which would touch the stencil sheet discharge roller 16 contaminated with ink, the roller cover 42 prevents the trailing end 3*a* from being contaminated with the ink of the stencil sheet discharge roller 16.

Figure 2:
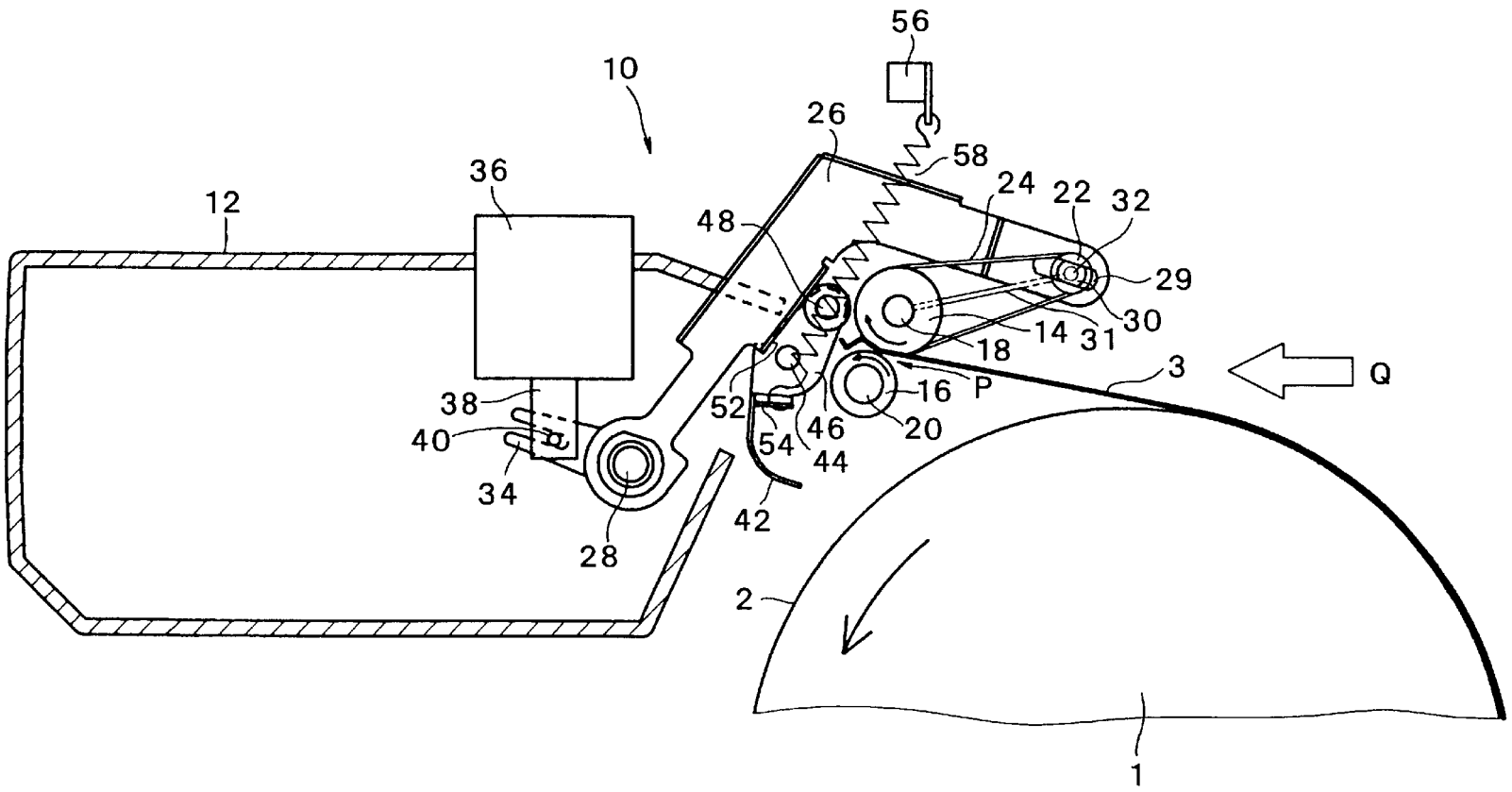
FIG. 2 is a side view showing the same embodiment in its operating state.

The operation of the stencil sheet discharge device 10 will be described with reference to FIG. 2 showing it in its operating condition. At the same time as the clamp means 4 releases the leading end of the master, the shaft 20 is driven by the above-mentioned driving means connected thereto so that the stencil sheet discharge rollers 14 and 16 are rotated as shown by arrows in FIG. 2 via the above-mentioned mutually meshing gears, and also at the same time the solenoid 36 is energized so that the armature 38 is moved upward, so that thereby pivoting the support member 26 around the pivot shaft 28 to let it approach the printing drum 1, with the endless belts 24 being approached to the printing drum 1, so as thereby to provide an effective guiding means for the leading end of the master. In such a movement, the shaft 32 of the rotary member 22 supporting the endless belts 24 moves along the elongated hole 26 via the shoe member 30, while maintaining the constant distance against the shaft 18 of the roller 14 by means of the rod member 31. At the same time, according to the pivotal movement of the support member 26, the guide surface 52 thereof pushes the roller 50 provided at the arm portion 46 of the roller cover 42, so that the roller cover 42 is pivoted around the shaft 44 in the clockwise direction in the figure against the biasing force of the tension coil spring 58, thereby moving the roller cover 42 to a position displaced apart from the stencil sheet discharge roller 16, so as not to disturb its stencil sheet discharging operation.

In this connection, the leading end of the master released from the clamp means 4 may be blown toward the endless belts 24 by a wind supplied in the direction shown by an arrow Q from a fan not shown in the figure, so that the leading end of the master is definitely conducted to the master receiving area P according to the rotation of the endless belts 24 and the rotation of the printing drum in the direction shown by the arrow. When the leading end of the master has been clamped by the stencil sheet discharge rollers 14 and 16, the master is removed from the outer circumferential surface of the printing drum 1, while maintaining an expanded condition, according to the rotation of the rollers 14 and 16 and the printing drum 1, toward the stencil sheet disposal box, to be disposed.

Since the roller cover 42 is retracted from the front area of the pair of stencil sheet discharge rollers not to obstruct the entrance of the leading end of the master to the stencil sheet receiving area P, it does not occur either that the roller cover is contaminated with the ink attached to the perforated sheet side of the master.

When the stencil sheet discharge operation was finished, the drive means connected to the shaft 20 is stopped so that the rotation of the stencil sheet discharge rollers 14 and 16 ceases, while the solenoid 36 is deenergized, whereby the support member 26 is rotated in the counter-clockwise direction in the figure about the pivot shaft 28 by the biasing force of the tension coil spring 58 applied thereto via the roller cover 42, so that the rotary member 22 carrying the endless belts 24 is pivoted in the counter-clockwise direction in the figure around the stencil sheet discharge roller 14, while the roller cover 42 is pivoted in the counter-clockwise direction in the figure around the shaft 44 with its roller 50 mounted at its end of its arm portion 46 being rotated along the guide surface 52 of the support member 26 until it covers the stencil discharge roller 16 against the printing drum 1 as shown in FIG. 1.

Figure 3:
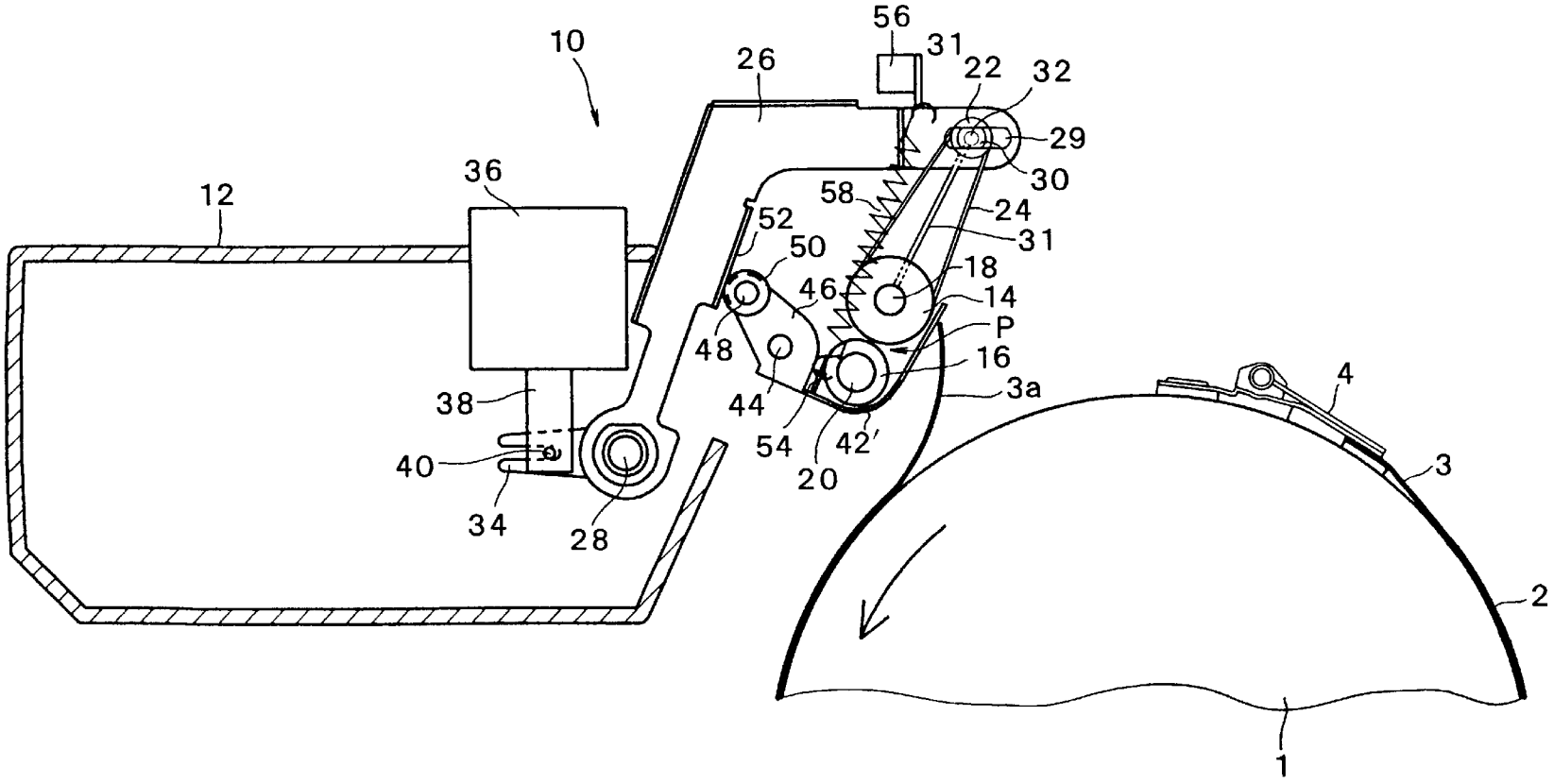
FIG. 3 is a side view showing a modification of the embodiment shown in FIG. 1.

FIG. 3 is a side view similar to FIG. 1, showing an embodiment modified from the embodiment shown in FIGS. 1 and 2 so that the roller cover 42 covers not only the stencil sheet discharge roller 16 but also the stencil sheet discharge roller 14 against the printing drum 1. In FIG. 3, the portions corresponding to those shown in FIG. 1 are designated by the same reference numerals, with omission of repetitive descriptions thereof. In this embodiment, in the non-operating state of the stencil discharge device, the roller cover 42' extends over a position to cover the stencil discharge roller 16 and the stencil sheet receiving area P against the printing drum until it reaches a position to cover the stencil sheet discharge roller 14 against the printing drum 1. Even when the upcurl of the trailing end 3*a* of the master is so extensive as to reach the stencil sheet discharge roller 14, it is prevented that the stencil sheet discharge rollers 14 and 16 are contaminated with ink by the trailing end of the master touching those rollers during the rotation of the printing drum 1.

Although the invention has been described in detail with respect to a particular embodiment and its partial modification, it will be apparent for those skilled in the art that various other modifications are possible without departing from the spirit of the present invention.

I claim:

1. A stencil sheet discharge device of a rotary stencil printer having a printing drum, the stencil sheet discharge device comprising a pair of stencil sheet discharge rollers positioned adjacent to an outer circumference of the printing drum for transferring a stencil sheet removed from the outer circumference of the printing drum toward a stencil sheet discharge spot, wherein said stencil sheet discharge device further comprises shield means removably positioned in a clearance between at least one of said pair of stencil sheet discharge rollers and said printing drum with a face thereof confronting the outer circumference of the printing drum such that said one stencil sheet discharge roller is shielded therebehind against the circumference of the printing drum with no portion of an outer circumference of said one stencil sheet discharge roller protruding toward the circumference of the printing drum across the face of the shield means as viewed in a longitudinal direction of said one stencil sheet discharge roller, and means for removing the shield means out of said clearance so as to expose said one stencil sheet discharge roller toward the circumference of the printing drum when the stencil sheet discharge device transfers the stencil sheet removed from the outer circumference of the printing drum toward the stencil sheet discharge spot.

2. A stencil sheet discharge device of a rotary stencil printer having a pair of stencil sheet discharge rollers for transferring a stencil sheet removed from an outer circumference of a printing drum toward a stencil sheet discharge spot, a rotary member positioned apart from one of said pair of stencil sheet discharge rollers, and an endless belt suspended around said one of said pair of stencil sheet discharge rollers and said rotary member, wherein said stencil sheet discharge device comprises a shield means adapted to be positioned at a shielding position located between a stencil sheet receiving area defined between said pair of stencil sheet discharge rollers and said printing drum when the stencil sheet discharge device is in a non-operating state thereof so as to shield at least a part of said pair of stencil sheet discharge rollers against said printing drum, and a support means adapted to support said shield means at said shielding position and said rotary member at a retreat position thereof, respectively, when the stencil sheet discharge device is in said non-operating state, said support means being movable to move said rotary member around a central axis of said one of said pair of stencil sheet discharge rollers to an advance position thereof close to said printing drum and to move said shield means to an open position thereof not obstructing said stencil sheet receiving area from being exposed to said printing drum.

3. A stencil sheet discharge device according to claim 2, wherein said shield means is biased to said shielding position by a biasing means and adapted to be moved to said open position by said support means against a biasing force of said biasing means.

4. A stencil sheet discharge device according to claim 2, wherein said support means is a pivotable means having an elongated hole for supporting a shaft of said rotary member to be movable therealong, and said shield means is a pivotable means having an arm means, said arm means having an end slidably engaged with a side portion of said support means so that said shield means is moved between said shielding position and said open position in synchronization with a pivotal movement of said support means for moving said rotary member between said retreat position and said advance position.

* * * * *